United States Patent [19]

Kicherer et al.

[11] Patent Number: 4,899,033

[45] Date of Patent: Feb. 6, 1990

[54] ELECTRIC HOTPLATE CONNECTING PIECE

[75] Inventors: Robert Kicherer; Felix Schreder; Stefan Reif, all of Oberderdingen, Fed. Rep. of Germany

[73] Assignee: E.G.O. Elektro-Gerate Blanc u. Fischer, Fed. Rep. of Germany

[21] Appl. No.: 236,768

[22] Filed: Aug. 25, 1988

[30] Foreign Application Priority Data

Aug. 27, 1987 [DE] Fed. Rep. of Germany ..... 3728528

[51] Int. Cl.[4] ..... H05B 3/70

[52] U.S. Cl. ..... 219/451; 219/457

[58] Field of Search ..... 219/451, 457, 458, 459, 219/460, 464, 467, 448, 449, 461, 463

[56] References Cited

U.S. PATENT DOCUMENTS 2,101,110 12/1937 Thornton ..... 219/457
3,021,414 2/1962 Sand ..... 219/463
4,122,330 10/1978 Fischer ..... 219/449
4,410,793 10/1983 Fischer ..... 219/449
4,467,181 8/1984 Fischer ..... 219/458

FOREIGN PATENT DOCUMENTS 3540815 5/1987 Fed. Rep. of Germany .
3540816 5/1987 Fed. Rep. of Germany .

*Primary Examiner*—Teresa J. Walberg
*Attorney, Agent, or Firm*—Steele, Gould & Fried

[57] ABSTRACT

For the in particular fully automated electrical connection of electric hotplates (2) to connecting lines (15) a connecting piece with an insulator (18) is provided, which is provided outside two remote end faces (25, 26) with pin-like connecting parts (20, 21) at right angles to its main longitudinal direction, in such a way that they are located in crossing manner to the incoming connecting parts (16, 17) to be connected thereto and are reliably connected thereto at the junctions (22, 23) by spot welding. On the end faces (25, 26) are also provided centering recesses (32) or guiding and orienting faces (35, 36) for the incoming connecting parts (16, 17), so that a self-orienting effect is obtained on assembly.

27 Claims, 12 Drawing Sheets

1
2
3
4
5
6
7
8
9
10
11
12
13
14
15
16
17
18
19
20
21
22
23
45
46

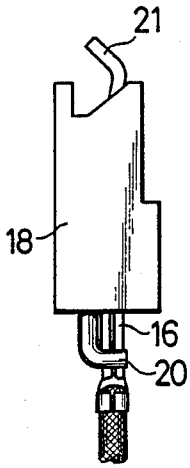
FIG. 3
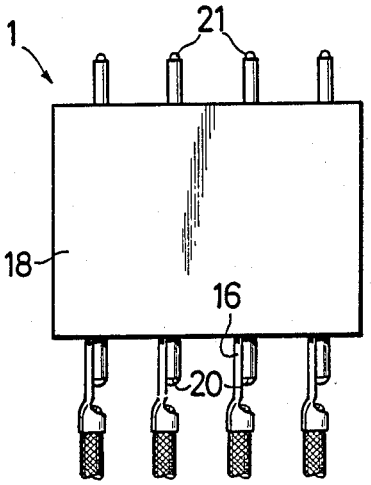
FIG. 4
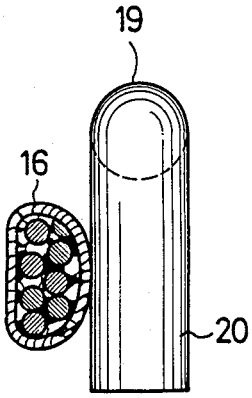
FIG. 5
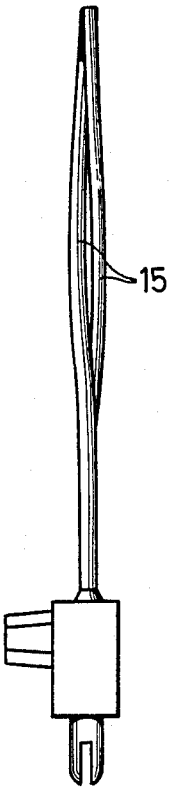
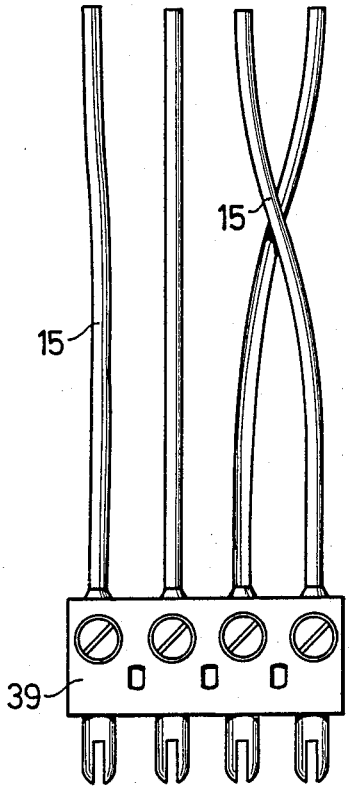

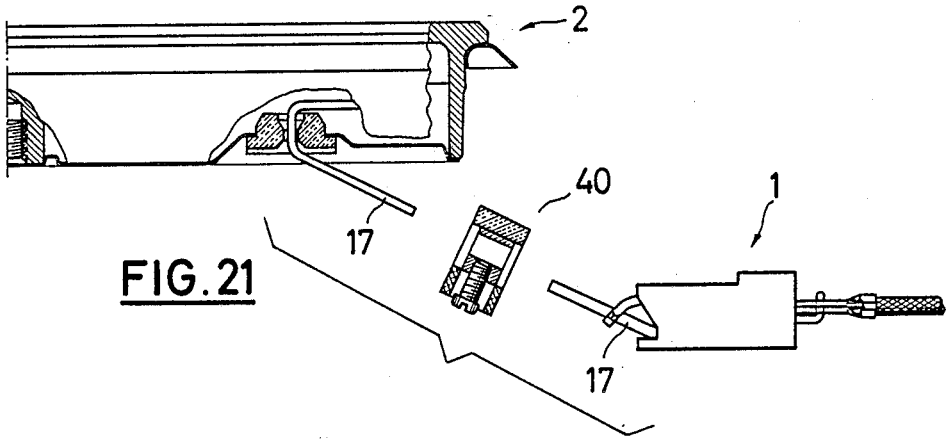
FIG. 21
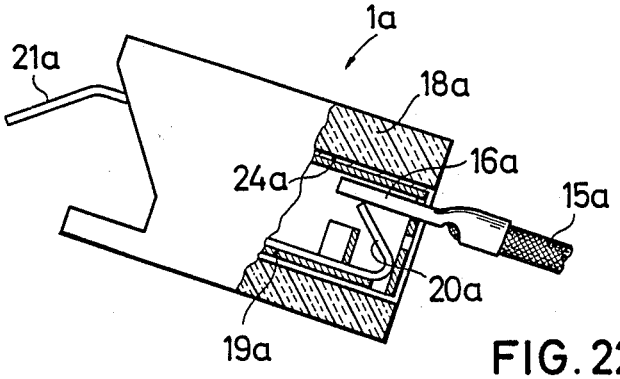
FIG. 22
FIG. 23
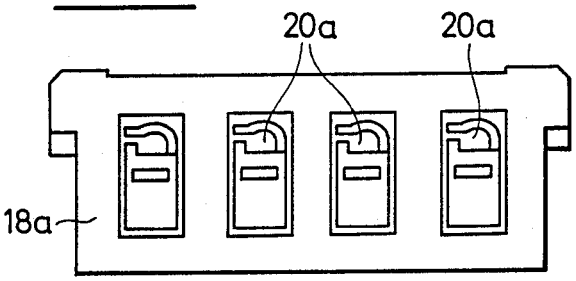

ELECTRIC HOTPLATE CONNECTING PIECE

BACKGROUND OF THE INVENTION

1. Field of the Invention.

The invention relates to an electric hotplate connecting piece with an insulator and at least one projecting connecting part for connection to a freely projecting, incoming mating connecting part.

2. Prior Art

In particular in the case of electric hotplates, but also for similar electrically operated components, there is an increasing need for a substantially automated assembly, e.g. using robots. Good results can be achieved through the construction according to DE-OS 35 40 815 and DE-OS 35 40 816, in which the connecting parts are assembled in the manner of plug connectors. A significant problem when connecting the connecting parts is that they must be made as simple and compact as possible, but can be so joined that a completely satisfactory, electrically conducting connection is obtained.

SUMMARY OF THE INVENTION

An object of the present invention is to provide a connecting piece of the indicated type, whose connecting part or parts can on the one hand be very simple and compactly constructed and on the other hand a connection with the incoming connecting part or parts within close tolerances is ensured.

According to the invention this object is achieved by a connecting piece of the aforementioned type, in that at least one connecting part of at least one lead is constructed for a crossing connection with the associated incoming connecting part. As a result very simple, e.g. rod-like connecting parts formed solely by wire ends or arms can be so brought together for or before connection, that in side view they project over one another in cross-like manner by their ends and e.g. at the crossing point the electrically conductive connection can be formed. The crossing angle can be precisely at right angles or diverging slightly, e.g. by less than 20° or approximately 10° from the right-angled arrangement.

As a rule, the connecting piece has two, three, four or even more leads and must then also have a corresponding number of connecting parts and appropriately all the connecting parts associated with one connecting side are substantially identically constructed and are so juxtaposed in a row that, considered in the row longitudinal direction, they are congruent. The connecting parts on both connecting sides of the connecting piece can also be differently constructed for adapting to the particular requirements.

In addition to the described construction and optionally also in place of the same with differently constructed connecting pieces, the invention proposes to provide at least one guidance and orientation surface for at least one incoming connecting part, so that when the latter is assembled with the connecting piece it is automatically guided into its connecting position and is secured by centring in the connecting position. The guidance surface, which is appropriately formed by at least one sloping surface, can also be formed by the connecting part or the lead, but is appropriately provided on the insulator, which is e.g. made from a ceramic material, such as steatite and whose guide surface is appropriately glazed or in some other way smooth in glass-like manner, so that very small frictional resistances act on the incoming connecting part.

It is also conceivable to construct the crossing connection in the manner of a plug connection, e.g. in such a way that a connecting part has two juxtaposed legs or flanks and the other, crossing connecting part engages between the legs. In addition thereto or in particular in place thereof, a particularly simple automated handling and a very reliable electrically conductive connection is obtained if the crossing connecting parts are constructed for a welded connection, e.g. so that welding exclusively takes place at the crossing point or intersection. On at least one connecting side, i.e. on the connecting side for the connecting member or on the connecting side for the connecting line, it is also possible to provide at least one connecting part of the connecting piece for connection to the incoming connecting part exclusively by assembling together and the plugging opening is appropriately located on the connecting piece and is e.g. formed by a plug connection, e.g. a spring clip, tulip clip, screw clip or the like. The incoming connecting part can then be constructed in simple manner as a pin-like plug, e.g. can be formed by the end of a wire-like connecting member of the hotplate or the like, a multicore cable end of the connecting line or the like.

The plug connection can also be constructed in such a way that the lead has or forms a plug or a plug pin-like plugging member, preferably a flat plugging tongue. Such electrically conductive plug connections are particularly suitable for those electric hotplates, which have low residual capacities and which are equipped with a temperature limiting switch, which e.g. has a switch casing located between an inner flange edge and a central stud of the hotplate body, as well as a temperature sensor influencing the associated switch, such as a snap-action switch and which appropriately projects in rod-like manner over the switch casing and is located on the underside of the heated field of the hotplate body.

These and further features of the preferred further developments of the invention can be gathered from the claims, the description and the drawings, whereby individual features either alone or in the form of subcombinations can be realized in an embodiment of the invention or in other fields and can constitute advantageous constructions for which patent protection is independently claimed .

BRIEF DESCRIPTION OF THE DRAWINGS.

Illustrative embodiments of the invention are shown in the drawings and are explained hereinafter. In the drawings show:

FIG. 3 The connecting piece in conjunction with the connecting lines and a multiple plug in side view.

FIG. 4 The arrangement according to FIG. 3 in elevation.

FIG. 5 A detail of FIG. 4 in section and on a larger scale.

FIG. 21 A repair arrangement with a connector for connecting a replace electric hotplate to an already welded connecting piece.

FIG. 22 A cross-section through a connecting side of another embodiment of a connecting piece.

FIG. 23 The connecting piece according to FIG. 21 in a view from the right.

DETAILED DESCRIPTION OF THE PREFERRED EMBODIMENTS.

Figures 1, 2:
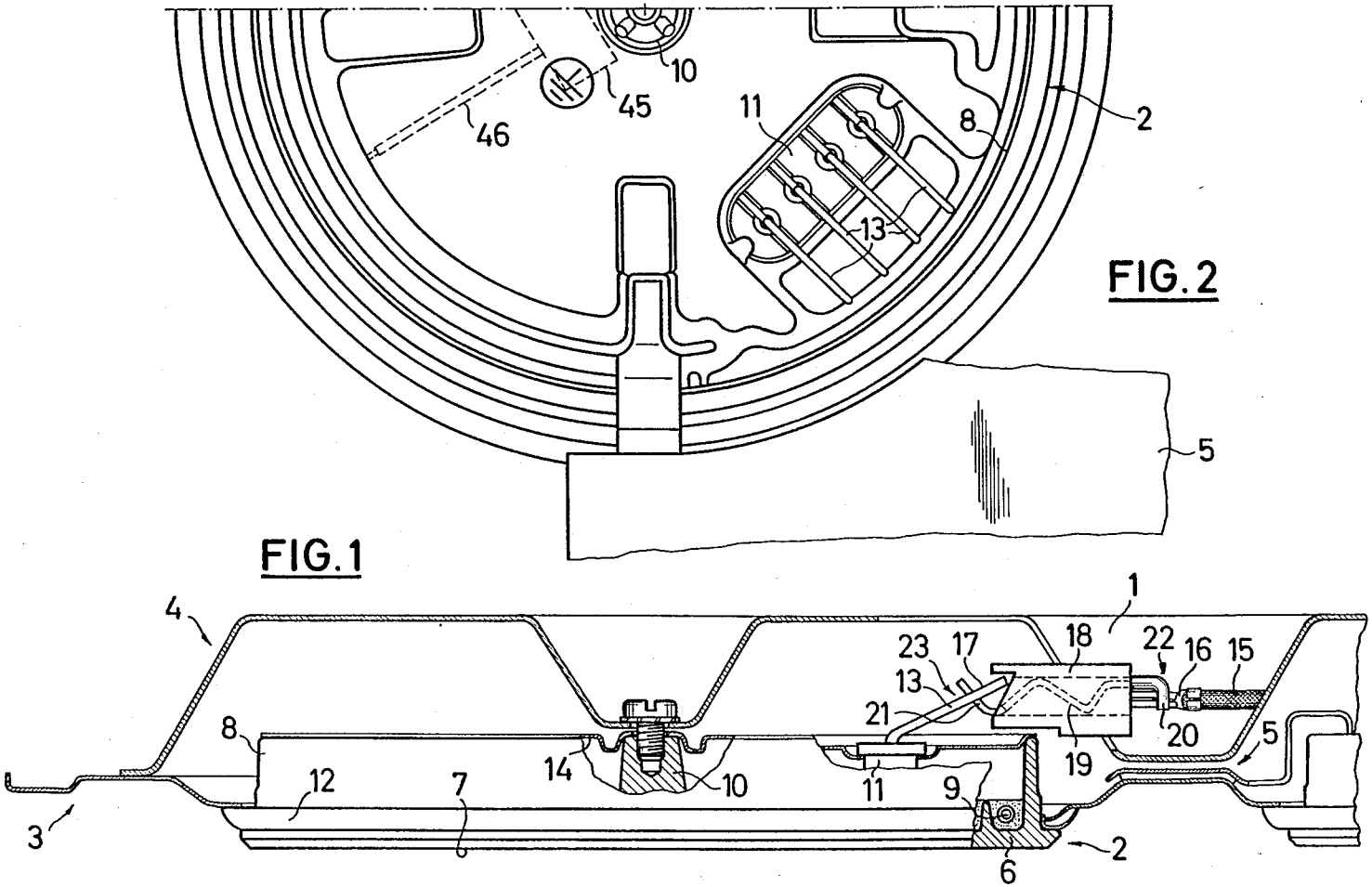
FIG. 1 an electric hotplate connected by means of an inventive connecting piece in part sectional upside down position.
FIG. 2 A detail of the underside of the hotplate according to FIG. 1.
Figure 6:
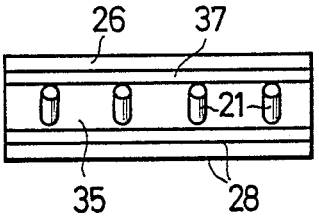
FIG. 6 A connecting piece in a view of a connecting side.
Figure 7:
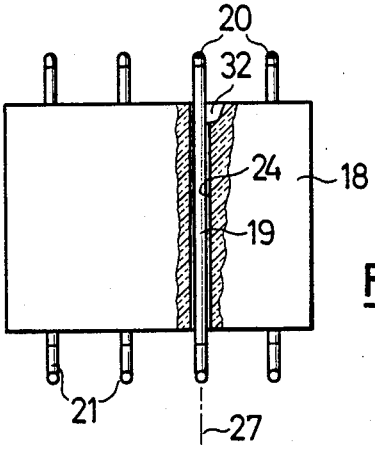
FIG. 7 The connecting piece in part sectional view.
Figure 9:
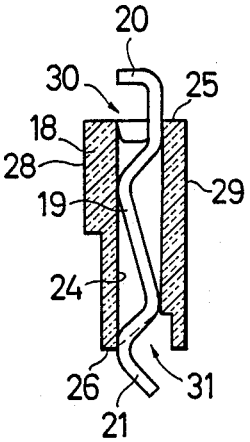
FIG. 9 A cross-section through the connecting piece according to FIG. 7.
Figure 8:
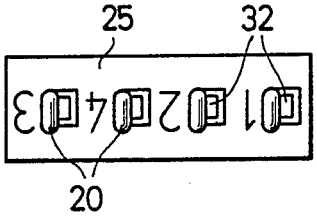
FIG. 8 The connecting piece in a view of the other connecting side.
Figure 10:
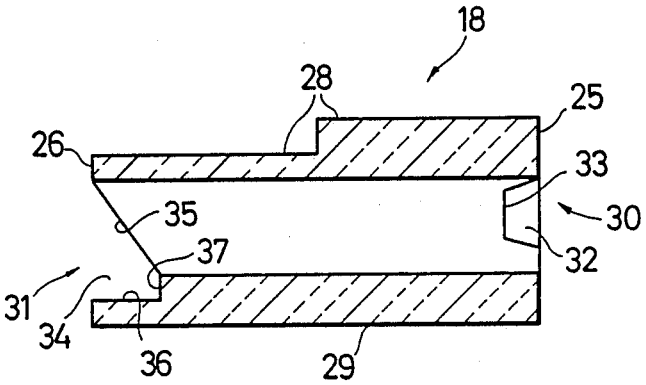
FIG. 10 A cross-section corresponding to FIG. 9 through the insulator of the connecting piece on a larger scale.
Figure 11:
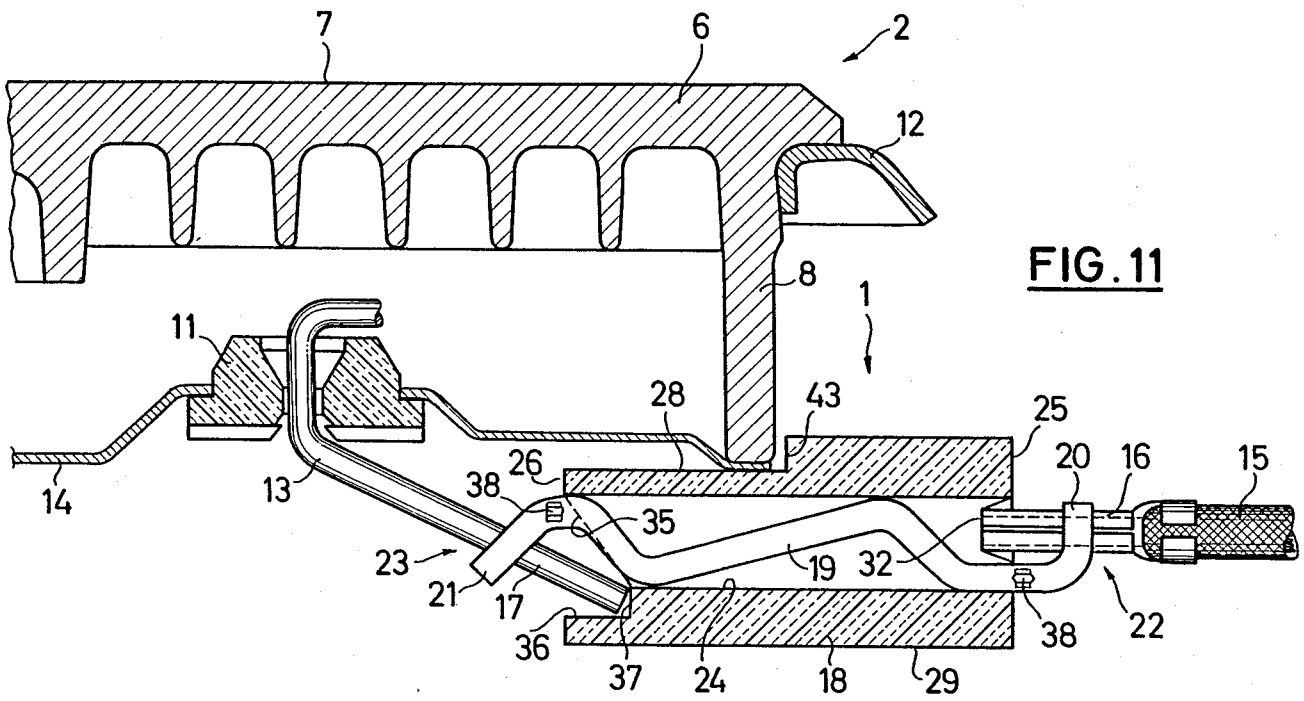
FIG. 11 The connecting piece according to FIGS. 1 to 10 in a larger-scale, sectional representation and in the installed state.

As can be gathered from FIGS. 1 and 2 an invention connecting piece 1 is used for connecting an electrical subassembly more particularly in the form of an electric hotplate 2, which in single or multiple form are to be fixed to form a prefitted assembly in openings of a profiled, sheet metal hob plate 3. For tensioning the hotplate 2 against the top of the hob plate 3 is provided a holding part 4 located on its underside and for reinforcing the hob plate 3 and for preventing rotation of one or more hotplates 2, between the hob 3 and the holding part 4 is located an intermediate part 5. Hotplate 2 has an e.g. cast material hotplate body 6, whose upper, planar surface has a circular, polygonal or similar ring-like closed cooking surface 7 and which is provided on its underside with a downwardly projecting, outer flange edge 8 set back slightly with respect to its outer circumference. Within this outer flange edge 8 and optionally between the latter and a corresponding inner flange edge within a ring zone leaving free a central zone heating resistors 9, e.g. three heating resistors suitable for a 7-cycle circuit in the form of wire coils are embedded in a compressed insulating material in spiral grooves on the underside of the hotplate body 6.

The hotplate body 6 is centrally provided with a central stud 10 projecting from its underside in the downwards direction by roughly the same distance as the flange edge 8 and in which engages a locking member, e.g. a screw, with which the holding part 4 is fixed against the underside of the hotplate body 6 in such a way that it is supported in braced manner on the underside of the hob 3 adjacent to the electric hotplate 2 and optionally accompanied by the interposing of intermediate part 5. The holding part 4 can be a clip, a cover-like or profiled plate-like part and can be separately provided for each hotplate 2 or jointly for two or more or all the hotplates 2 of hob 3.

For supporting on the top of the hob 3, the electric hotplate 2 has on the outer circumference of the outer flange edge 8 a sheet metal profile support ring 12, which covers the assembly opening in hob 3 in the manner of a shield. The underside of the hotplate body 6 is substantially closed by a sheet metal cover plate 14, which is supported on the end face of the flange edge 8 and/or the central stud 10 and can be fixed with the same holding member as holding part 4 with respect to the hotplate body 6. The cover plate is traversed by a steatite or similar insulating sleeve 11 fixed thereto and which in the view according to FIG. 2 can be oval and is used for the juxtaposed, separate passage of relatively bending-resistant or inherently rigid electrical conductor portions made from wire or the like, which are bent on the inside and outside of the insulating sleeve 11 and within the hotplate body are connected to heating resistors 9 e.g. by means of end pins projecting out of the insulating material.

Outside the hotplate body 6 or on the underside of the electric hotplate 2 said conductor pieces have in each case a connecting member 13, the connecting members 13 being provided in juxtaposed manner for the electrical connection of the electric hotplate 2 with the aid of the connecting piece 1. The electric hotplate 2 can be constructed overall or with regards to its electric terminals in much the same way as in DE-OS 35 40 815 or DE-OS 35 40 816, to which reference should be made for further details and effects and on at least one connecting side connecting piece 1 can have at least one of the connecting parts described therein. Assembly also takes place much as described in these specifications on the basis of a method, in which the electric hotplates are fitted upside down and electrically connected.

For the electrical connection of the connecting members 13 connecting lines 15 are provided, which are flexible or preferably bendable, but inherently rigid in the bent state, which can be enveloped by an e.g. braided insulation and have on their ends in each case an incoming connecting part 16, e.g. in the form of a multicore cable end associated with a connecting member 13. With respect to the connecting piece 1, the connecting member 13 forms an incoming connecting part 17.

The connecting piece 1 has an in plan view substantially elongated, rectangular and flat insulator 18 parallel to the cooking surface 7 and having a number of identical, juxtaposed leads 19 corresponding to the number of connecting parts 17 and which traverse parallel to one another the insulators 18 between two long narrow sides and on said two narrow sides in each case form projecting connecting parts 20, 21 for the incoming connecting parts, 16, 17, in such a way that in each case two connecting parts 16, 20 and 17, 21 can be electrically conductively interconnected in a junction 22 or 23.

As can in particular be gathered from FIGS. 4 to 11, insulator 18 has a number of cross-sectionally flat, rectangular, identical, juxtaposed through openings 24 and which are bounded over their entire circumference corresponding to the number of leads 19 and whose larger cross-sectional extension is at right angles to the flat extension and which traverse the insulators 18 between the two narrow sides or end faces 25, 26 belonging to the connection sides at right angles, i.e. parallel to the flat extension with a substantially constant width. Each lead 19 comprises a strand, which can optionally be formed from sheet metal or the like, but is appropriately formed by a round steel wire and whose central axis over its entire length and like the connecting parts 20, 21 is so located in a single median longitudinal plane 27 that the latter coincides with the corresponding longitudinal median plane of through-opening 24.

In said median longitudinal plane the lead 19 having constant cross-sections over its length is so curved between the end faces 25, 26 or is bent three times in opposite directions approximately at right or obtuse angles, that it can be supported between the end faces 25, 26 with two arcs on the two facing inner narrow sides of the through-opening 24 and immediately following on to the end faces 25, 26 once again with two portions roughly parallel to its main longitudinal direction or the longitudinal direction of the through-openings 24 on the opposite inner narrow sides of the through-opening. As the width or cross-sectional thickness of the lead 19 is approximately as large as the internal width of the passage-opening 24, this leads in simple manner to a rotation prevention of lead 19 with respect to the connecting body 18 whereby lead 19 can either engage with a limited motion clearance in through-opening 24 or is supported resiliently on the inner narrow faces with a certain pretension.

At least one connecting part 20, 21 could admittedly be formed by a separate component electrically conductively connected to the lead 19, but the connecting parts 20, 21 are appropriately constructed in one piece with the lead 19 as opposite bends. The connecting part 20 is bent in the direction of the plane of the cooking surface 7 or towards the top of the connecting piece 1 and the connecting part 21 away from the underside of the electric hotplate 2 or towards the underside of the connecting piece 1, in such a way that the connecting parts 20, 21 pass directly into those portions which are directly supported following on to the end faces 25, 26 on the two facing inner narrow faces of the through-opening 24. At least one connecting part 20, 21 and in particular 20 can also be located in an orientation different from that represented at right angles to the main longitudinal extension of the lead 19. Although in the view according to FIG. 8 inclined positions of these connecting parts are conceivable, it is particularly appropriate if in plan view according to FIG. 4 they are bent e.g. to the left, at right angles to the median longitudinal plane 27 and are preferably equiaxially aligned with one another or project freely in roughly the same direction. The connecting parts can be substantially parallel to the cooking surface. The two connecting parts 20, 21 can in this way always be at right angles and then appropriately the median longitudinal planes of the leads are correspondingly at right angles, e.g. in such a way that all the leads are located in a common median longitudinal plane. Connecting parts 21 can also be at right angles.

Connecting part 20 is located at a much greater distance than its cross-sectional width from the associated end face 25 and is parallel thereto or at right angles to the main longitudinal extension of the lead 19, whilst the connecting part with the associated end face 26 or with said main longitudinal extension forms an angle of approximately 45° and substantially passes linearly from a bend located directly at said end face 26. However, connecting part 20 emanates from a portion of lead 19, which projects in parallel to said main longitudinal direction into the through-opening 24 and is supported therein in the described manner.

Each of the connecting parts 20, 21 is so set back with respect to the two substantially parallel flat sides 28, 29, that is essentially does not project beyond the two facing planes of the two inner narrow sides of the passage opening 24, so that prior to insertion in the insulator 18, lead 19 can be completely bent. In the represented embodiment, each of the connecting parts 20, 21 is formed by a linear arm projecting freely in pin-like manner up to its end, but it is also conceivable to construct it as a transverse web of a clip or the like, e.g. in such a way that the free clip leg is led back into the passage opening 24. The upper flat side 28 of the insulator 18 is offset at its end associated with end face 26 and engaging below the electric hotplate 2 for engagement on the underside of the cover plate 14, so that the connecting piece 1 projects as little as possible over the underside of hotplate 2 and a stop shoulder 43 for engaging on the outer circumference of the flange edge or the like can be formed.

In the vicinity of the particular connecting part 20, 21, the insulator 18 has a guidance and alignment surface 30 or 31 for the reciprocal alignment of the connecting piece 1 with the particular incoming connecting part 16 or 17. Simultaneously the offset surface of the upper flat side 28 slides along the underside of hotplate 2 on bring together the latter and the connecting piece 1.

The guiding and aligning surfaces 30 for connecting part 16 of connecting lines 15 are formed by separate centering recesses 32, whereof each is associated with a single incoming connecting part 16 and which in the end face 25 are directly laterally adjacent to the passage openings 24 in such a way that in each case they are open on one side to the associated passage opening, i.e. are constructed as depressions in the associated lateral face of openings 24. All the centering recesses 32 are located on the corresponding side of the associated passage opening 24 and are so displaced in the direction of the inner narrow side of opening 24 that they are connected to said narrow side and do not extend over the entire cross-sectional height of opening 24. On their three inner circumferential boundaries which are at an angle to one another, the in elevation rectangular centering recesses 32 are narrowed in funnel-shaped manner towards their bottom faces, the latter forming stop faces 33 for the end faces of the incoming connecting part 16.

The guiding and aligning faces 31 on end face 26 are formed by a groove 34 common to all the connecting parts 21 and which is provided over the entire length of said end face and is deeper than centering recess 32. The lateral face of the groove located towards the upper flat side 28 is inclined by a relatively steep angle of more than 45° with respect to the main longitudinal direction of lead 19, whilst the other lateral face is parallel to said main longitudinal direction and the bottom face 37 is at right angles thereto. The inclined lateral face forms a single guiding face 35, which in the same way as the bottom face 37 forms the associated portion of end face 26, but only extends between the inner narrow faces of through-opening 24, in such a way that the individual guiding face 36 converging inwards at an acute angle with the individual guiding face 35 is displaced towards the lower flat side 29 with respect to the associated inner narrow side of opening 24. Thus, a web is provided, which projects from end face 26 and is bounded by the guiding face 36 and the flate side 29 and which can serve as a stop web for the incoming connecting part 17.

On automatically assembling the connecting piece 1 with the connecting wires 13 projecting in inclined manner from the underside of electric hotplate 2, the ends pass from the connecting part 17 to the inclined individual guiding face 35, e.g. at a distance from the bottom face 37, so that on further assembly either the connecting piece 1 is passed in the direction against the underside of electric hotplate 2 or the connecting wires 13 with the aid of the connecting piece 1 are bent away to such an extent from the underside of the hotplate that they strike against the bottom face 37 or optionally against the individual guiding face 36. In this position, all the connecting parts 17 are located on the corresponding same side of the associated connecting part 21, whereby in the side view of FIG. 11 the connecting parts cross one another in pairwise right-angled manner close to insulating sleeve 11. The distances between adjacent connecting parts 21 are larger than their diameter or thickness, so that the connecting parts 17 can initially be inserted in contact-free manner between the connecting parts 27, after which the connecting part 1 is laterally displaced until all the connecting parts 17, 21 engage pairwise in punctiform manner. The pairs of connecting parts 17, 21 can then be rigidly and self-supportingly interconnected simultaneously or successively using fine spot welding tongs. As a result of the described construction such a high strength is obtained that the connecting piece 1 is carried solely by the connecting wires 13 on the underside of hotplate 2 and no further fastening is required.

Connecting part 16 of connecting lines 15 can be admittedly connected to the electric hotplate 2 following the fitting of connecting piece 1, but the procedure adopted is advantageously such that initially the connecting piece 1 is connected to the connecting part 16 and is only then connected to connecting part 17. The automated connection of connecting part 16 takes place through all the connecting parts 16 together or in direct succession being moved against the end face 25 of insulating body 18 between connecting parts 20. Connecting piece 1 is moved at right angles to the correspondingly aligned connecting part 16 until it strikes against the connecting parts 20, after which the connecting parts 16 are at least approximately aligned with the centering recesses 32 and, to the extent necessary, and accompanied by more precise alignment on the side faces of centering recesses 32 up to striking against the stop faces 33 and are introduced into the same. As shown in FIG. 5, the connecting parts 16 in the manner of multicore cable ends are in each case formed by a sheet metal casing with a longitudinal seam gap bent around the strands of the associated connecting line 15 and with which they are appropriately applied to the connecting parts 20. In side view, the ends of the connecting parts 20 do not project or only project by a small amount compared with their diameter beyond the connecting parts 16, whereas the connecting parts 21 project further beyond the connecting parts 17.

To secure leads 19 or connecting parts 20, 21 against displacement in the longitudinal direction of the passage openings 24, stops 38 are provided, which are preferably constructed in one piece with the lead 19 and are formed by cams squeezed out laterally on both sides and with which are associated end faces 25, 26 as opposite stope faces. As shown in FIGS. 3 and 4, the ends of the connecting lines 15 remote from connecting piece 1 can be connected to a common multiple plug 39, by means of which the electric hotplate 2 can be connected in simple manner to a manually operable switch for setting the different power stages. Leads 19 or connecting parts 20, 21, like the connecting parts 17 are made from so-called spot welding wire suitable for spot welding, whereas the connecting parts 16 are appropriately made from stainless steel or nickel-plated steel. Connecting piece 1 can also be constructed or used for two or three-pin connection. Insulator 19 is appropriately made from a ceramic material, e.g. steatite. In place of the position according to FIG. 11, the connecting parts 21, particularly in the case of right-angled alignment, can also be connected in a position in which the connecting parts 17 are directed more steeply downwards and then after fixing the connecting piece 1 are transferred upwards into the position according to FIG. 11.

In FIGS. 12 to 26 corresponding parts are given the same reference numerals as in the other drawings, but followed by different letter references, so that the corresponding parts of the description appropriately apply.

Figure 14:
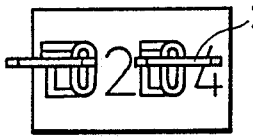
FIG. 14 The connecting piece according to FIG. 12 in a view from the right.
Figure 12:
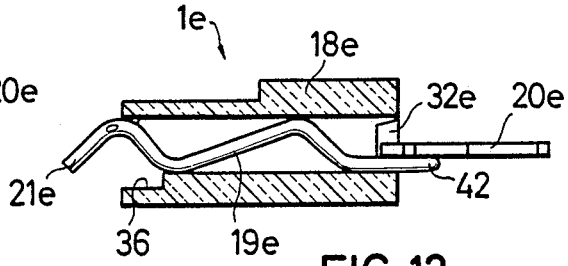
FIG. 12 Another connecting piece in longitudinal section.
Figure 13:
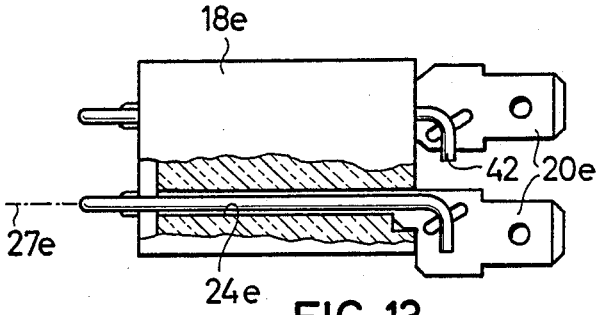
FIG. 13 The connecting piece according to FIG. 12 in part sectional plan view.

In the embodiment according to FIGS. 12 to 14 the two ends of the lead **19*e* are at right angles to one another and the end 42 associated with connecting part 20*e* is at right angles to the median longitudinal plane 27*e*. This end 42 is not directly provided as a connecting part and instead end 42 is fixed to a separate plugging member 20*e* in the form of a flat plugging tongue, which is substantially formed by a through-planar, plate-like part. The latter has a slightly widened, compared with the plugging tongue, shaft attachment located outside the insulator 18*e* and on whose one surface engages flat the associated end 42 or the associated bent end part of lead 19*e*. The shaft attachment can have a rib-like part crossing end 42, which ensures a particularly good welded joint with end 42. Plugging member 20*e* also has a width-reduced projection emanating from the shaft part for engaging in recess 32*e*, which in this caes is not necessarily provided as a centering recess, but more particularly for the positive position securing and additional supporting of the plugging member 20*e* against movement at right angles to the median longitudinal plane 27*e*. Both or all the plugging members 20*e* are located in a common plane, while ends 42 are coaxially aligned. Each plugging member 20*e* also simultaneously forms a longitudinal stop for the associated lead 19*e*, in such a way that the latter is secured against movements in the sense of an insertion of plugging member 20*e* into insulator 18*e***.

Figure 15:
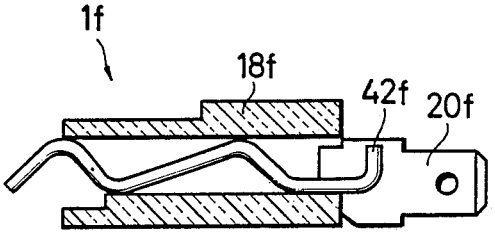
FIG. 15 Another embodiment of the connecting piece in longitudinal section.
Figure 16:
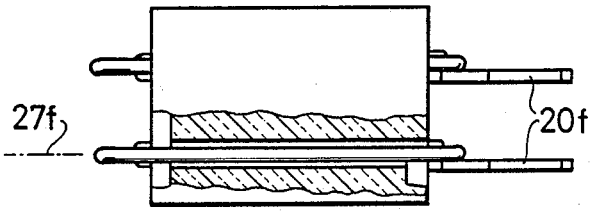
FIG. 16 The connecting piece according to FIG. 15 in a view corresponding to FIG. 13.

In the case of the construction according to FIGS. 15 and 16 at least two or all the plugging members **20*f* are juxtaposed in planes parallel to one another and to the median longitudinal planes 27***f*, the ends 42*f* also being parallel to one another or located in the associated median longitudinal plane 27*f*.

Figure 17:
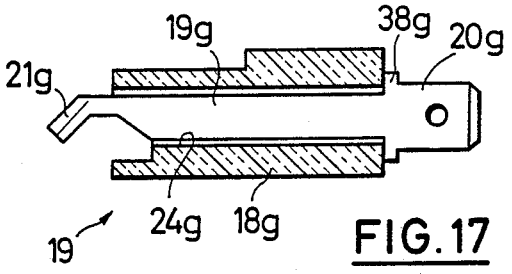
FIG. 17 Another connecting piece in longitudinal section.
Figure 18:
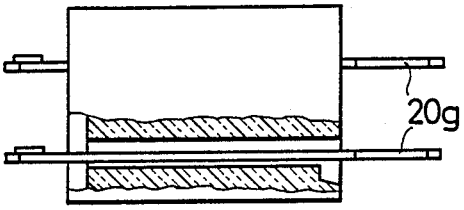
FIG. 18 The connecting piece according to FIG. 17 in representation corresponding to FIG. 13.

As can be gather from FIGS. 17 and 18, the plugging member 20*g* can also be constructed in one piece with lead 19*g*, which in this case is appropriately substantially formed from a strip-like, linear sheet metal part, whose width is adapted to the passage opening 24*g*. At the foot, the plugging member 20*g* forms two T-shaped, laterally projecting stops 38*g* as a longitudinal stop for engagement on the associated end face of insulator 18*g*. The also strip-like connecting part 21*g*, which is narrower than the central portion of lead 19*g* and is approximately located in the plane thereof, is substantially formed by a recess on one of the two longitudinal edges of the lead 19*g*, said recess having divergent lateral flanks and connecting part 21*g* is inclined with respect to the longitudinal direction of lead 19*g*. On one lateral face, connecting part 20*g* can have a projection for a better welded joint to the freely projecting, incoming connecting part of the electric hotplate.

Figure 19:
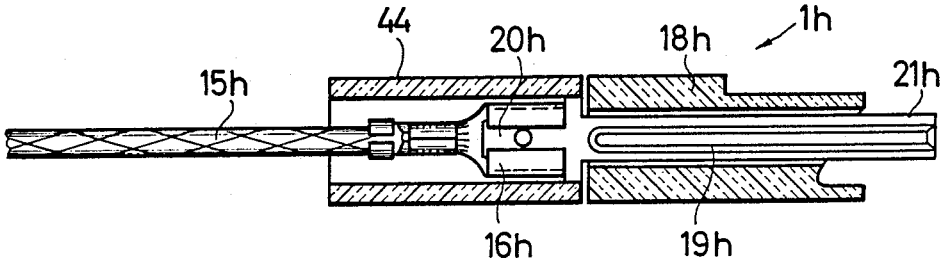
FIG. 19 Another connecting piece with connected connecting line in longitudinal section.
Figure 20:
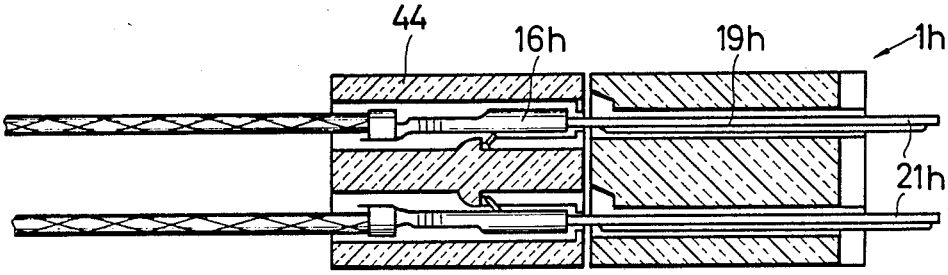
FIG. 20 The arrangement according to FIG. 19 in sectional plan view.

As shown in FIGS. 19 and 20, connecting part 21*h* can also be formed by a linear extension of the remaining, strip-like lead 19*h*, which appropriately has an a reinforcement a longitudinal rib projecting over one flat side to the end of connecting part 21*h*. Moreover, according to FIGS. 19 and 20, there is a casing-like insulator 44, which at least receives one incoming connecting part 16*h* or all such connecting parts 16*h* of the connecting lines 15*h* of a hotplate in substantially completely surrounded manner and in separate openings, so that these connecting parts 16*h* can be combined into a plug. The incoming connecting parts 16*h* are in this case flat plug sleeves for receiving the plugging members 20*h* constructed as flat plugs and by means of locking or detent tongues shaped therefrom is positionally secured against the insertion pressure in insulator 44. Although the plugging members 20*h* are plane-parallel or in the same planes as the connecting parts 21*h*, through a corresponding twisted construction of lead 19*h* one of the described angular positions is conceivable and the twisting can simultaneously serve for longitudinal locking with respect to insulator 18*h*. The external shape of insulator 44 forms in the connected state a continuous extension of the external shape of insulator 18*h* and consequently with the latter a continuous casing, whose parts are only locked through the engagement of the electrical plugging and mating plugging members and can be secured in that e.g. the lateral stops of the plugging members 20*h* engage in the insulator 44. The constructions according to FIGS. 12 to 20 are particularly suitable for those hotplates which, according to FIG. 2, have a thermal cutout indicated at 45 with an e.g. rod-like temperature sensor 46 for monitoring the maximum permitted temperature of the hotplate body.

The electric hotplate fitted and electrically connected in the described manner can be replaced in the case of repair by another hotplate, e.g. through using the same connecting piece 1 if, according to FIG. 21, a connector 40 constructed like a porcelain insulator is used, which has a connecting bush for each terminal. The electric hotplate 2 to be replaced is separated from the connecting piece 1 in that its connecting wires, without destruction, are cut through from the connection to the connecting parts 21 close to the insulating sleeve 11, so that the connecting parts 17 remain on connecting piece 1 and via the latter or the connecting parts 21 form linear connecting pins which project a relatively long way. These pins are inserted pairwise, together with the associated connecting parts 17 of the new electric hotplate 2 and from opposite sides into a bush of connector 40 and are then e.g. fixed by means of a setscrew.

According to FIG. 22 the connecting parts 20*a* can be formed on one connecting side or connecting piece 1*a*, e.g. for the connecting parts 16*a* of connecting lines 15*a*, by plug parts, particularly plugging bushes, which receive the incoming connecting parts 16*a* either in non-detachably interclawed manner or so as to be removable again. In this case the lead 19*a* is made from sheet metal, which also appropriately applies regarding the connecting parts 21*a*. Otherwise the same parts in FIGS. 22 to 26 are given the same reference numerals as in the remaining drawings, but are followed by different letter references.

Figure 24:
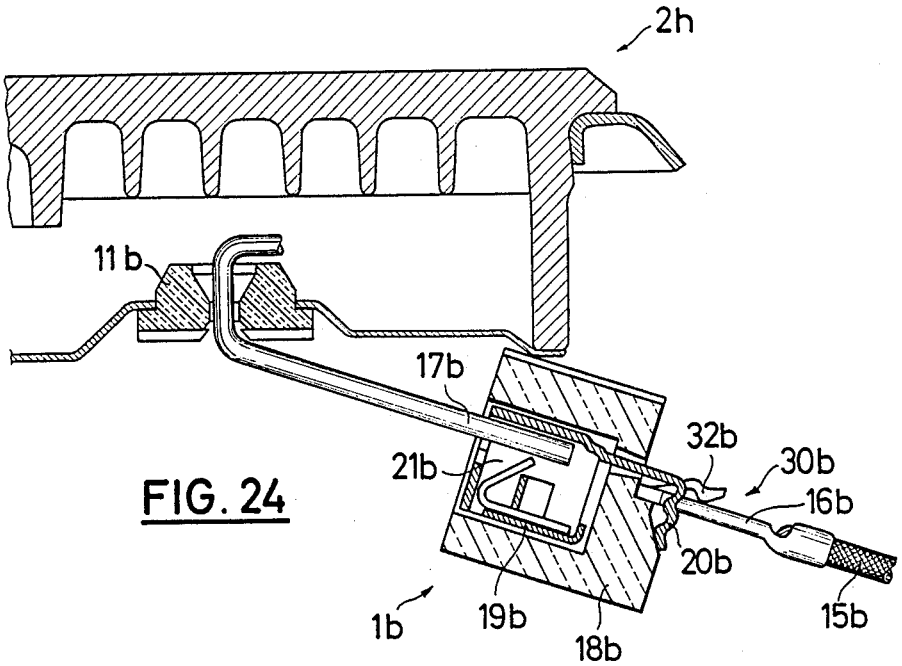
FIG. 24 Another embodiment of a connecting piece in conjunction with an electric hotplate in cross-section.

In the embodiment according to FIG. 24 the connecting parts 21*b* of the connecting piece 1*b* are formed by in particular bush-like plug parts, in which the connecting parts 17*b* of electric hotplate 2*b* are non-detachably interclawed or can be inserted so as to be removable again. As is also shown in FIG. 24, at least one individual orienting face of the guiding and orienting faces 30*b* of the connecting piece can also be formed by the associated lead 19*b* or the associated connecting part 20*b*, which appropriately has a correspondingly shaped, projecting flap. In the case of the construction of the connecting parts of the connecting piece as plugging bushes, they can be completely located within insulator 18*b*.

Figure 25:
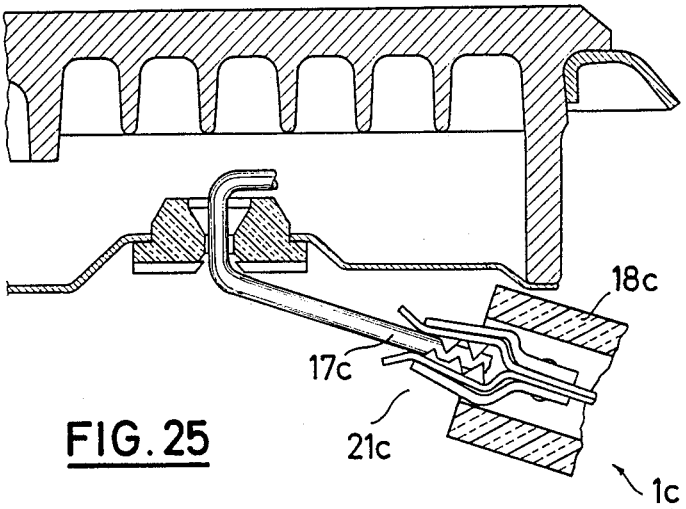
FIG. 25 Another embodiment of a connecting piece in a representation similar to FIG. 22.

According to FIG. 25 the plug connecting part 21*c* is constituted by a tulip clip projecting by part of its length over insulator 18*c* and which resiliently engages round the incoming connecting part 17*c* from two opposite sides in jaw and claw-like manner.

Figure 26:
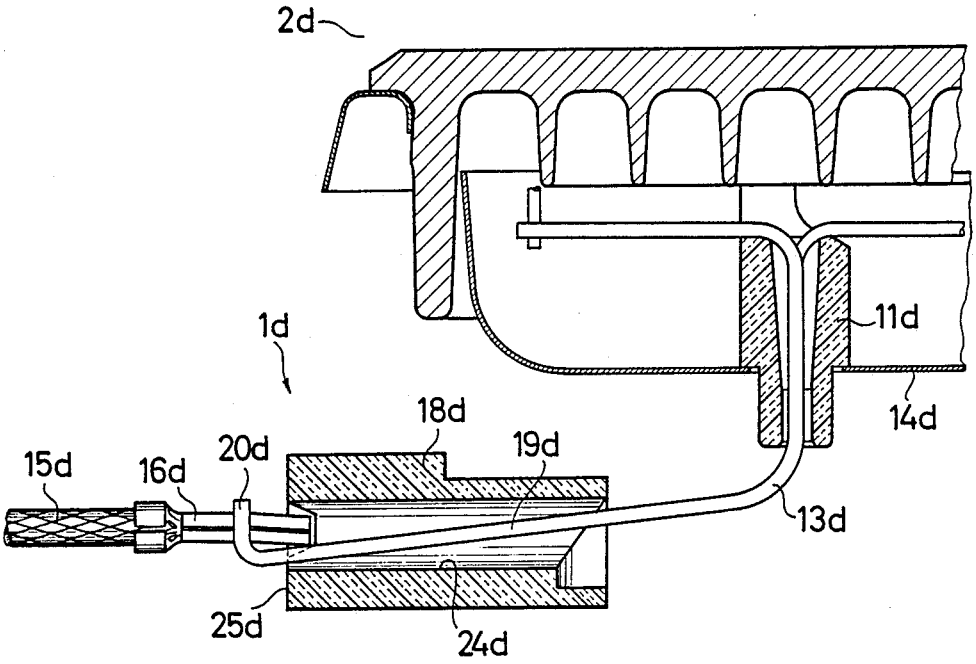
FIG. 26 Another embodiment of a connecting piece in a representation corresponding to FIG. 25.

As shown in FIG. 26 the lead 19*d* can also be constructed in one piece with a connecting wire forming at least part of the connecting line or with the associated connecting wire 13*d* of the electric hotplate 2*d*, which is passed through the associated passage opening 24*d* of the insulator 18*d* and adjacent to the associated end face 25*d* has a bend as a connecting part 20*d* constructed in one piece with connecting wire 13*d*. Insulator 18*d* can be constructed in the same way as that according to FIGS. 1 to 11 and, after spot welding connection to the incoming connecting part 16*d*, is either displaceable in the longitudinal direction of connecting wires 13*d* or is positionally secured with respect to the same by the indicated stops. Here again the connecting parts 20*d* can be at right angles in the described manner and the incoming connecting part 16*d* is appropriately fixed to the top of the associated connecting part 20*d*.

Figure 27:
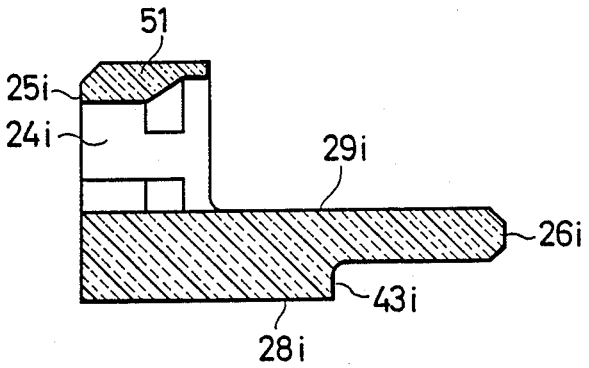
FIG. 27 The insulator of another connecting piece in longitudinal section.
Figure 28:
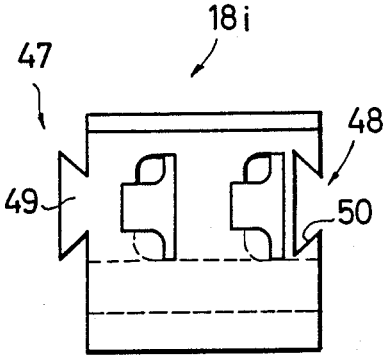
FIG. 28 The insulator according to FIG. 27 in a view from the left.
Figure 29:
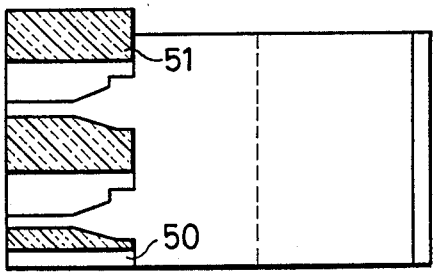
FIG. 29 The insulator according to FIG. 27 in a part sectional view of the underside.
Figure 30:
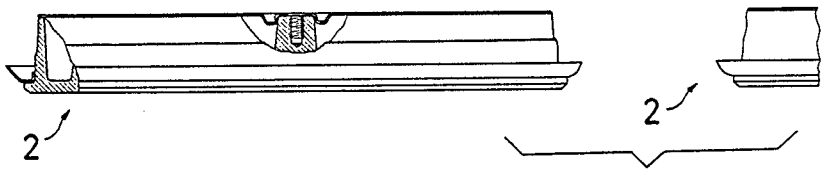
FIGS. 30 to 35 Successive phases of the assembly and electrical connection of an electric hotplate in a hob.
Figure 31:
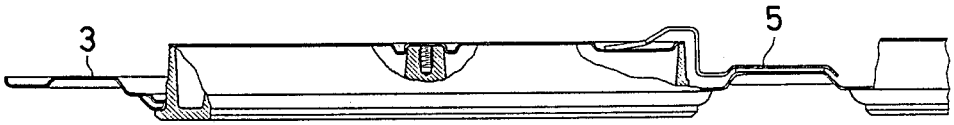
Figure 32:
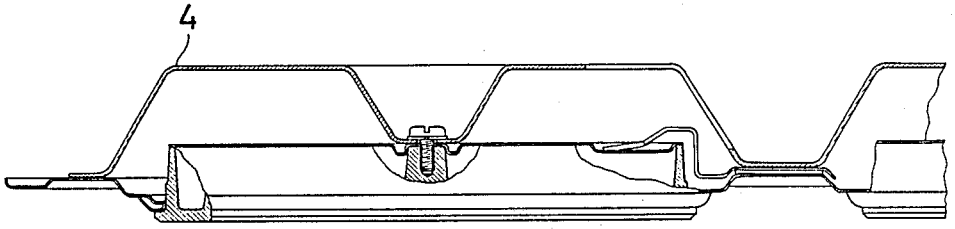
Figure 33:
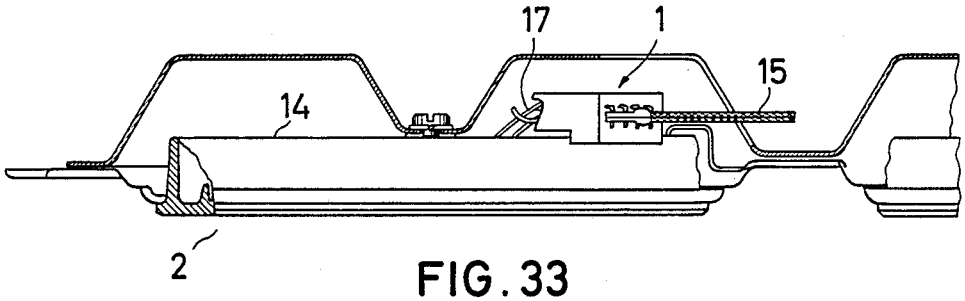
Figure 34:
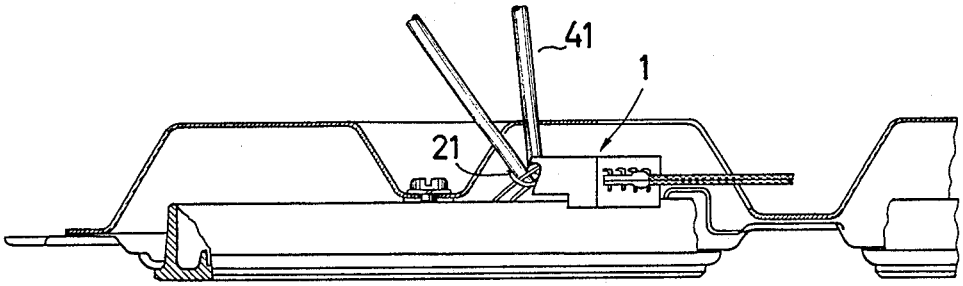
Figure 35:
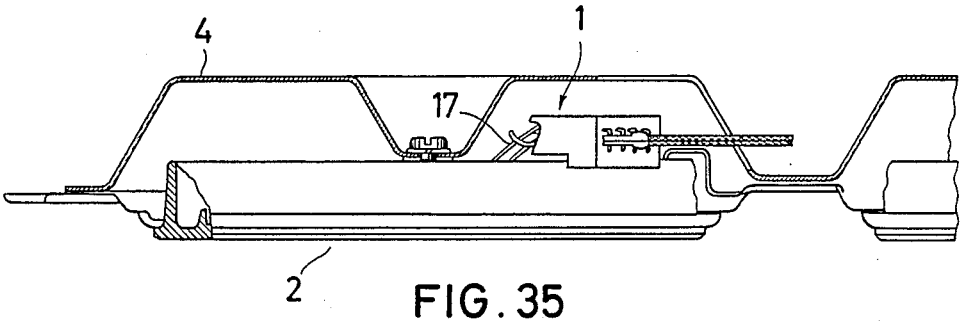

Insulator 18*i* according to FIGS. 27 to 29 has over a partial length emanating from end face 25*i* instead of over its entire length at least one passage opening 24*i*, while over the remainder of its length it is constructed in the manner of a plate-like projection, which at the side remote from opening 24*i* has the stop shoulder 43*i*, whereas in the vicinity of the passage opening 24*i* it is constructed in the manner of a casing part 51. On at least one side, this insulator 18*i* is provided with a connecting member 47 or 48 for connection to a further and in particular similar insulator. Each of the two or more interconnectable insulators can be constructed for the reception of one, two or more leads or electrical plug connections, which are not shown in FIGS. 27 to 29.

Insulator **18*i* is constructed for a two-pin plug connection, so that on assembling two similar insulators 18*i* a four-pin connecting piece is formed. Insulator 18*i* not only has on one side, but on both sides complementary connecting members in the form of a dovetail plugging member 49 and a dovetail plugging recess 50, whose parallel plugging direction is parallel to the longitudinal direction of insulator 18*i*. Thus, a random number of similar insulators 18*i* can be joined together in a row, although an arrangement of the connecting members for an e.g. star-shaped connection of the insulators would be conceivable. The connecting members 47, 48 are appropriately provided laterally on casing part 51, although when constructing the insulator according to one of the other drawings, they could be located approximately up to the insulator end associated with the hotplate or on said end. In the case of laterally joined together insulators 18*i*, they engage on one another in substantially whole-surface manner. Corresponding connecting members could also be provided on the insulator 44**, so that the latter can also be assembled from module-like components in random four-pin manner.

According to FIGS. 30 to 35, during the assembly of the electric hotplate the invention provides for the following procedure. The electric hotplates 2 provided for installation on a hob are automatically removed from a pallet in the upside down position and in geometrically predetermined arrangement are placed on an assembly bench. Then the hob plate 3 is inverted in upside down position over the electric hotplates 2 in such a way that they engage in the associated openings and then after hob 3 or together therewith the intermediate part 5, constructed as a stabilizing plate, is set down in such a way that the rotation preventing fingers provided thereon engage in corresponding recesses on the undersides of the hotplates 2. Holding part 4 constructed as an assembly plate is then put into position, fixed with the aid of locking members or screws on all the hotplates 2 and in this way fitted to a grounding connection on the cooker plate, which can be prefitted with the holding part 4 or fixed following the installation thereof. A tool is then used for raising the connecting parts 17 previously located in a recess in the underside of hotplate 2 or the cover plate 14, said tool having access through a window opening provided in the holding part 4. The connecting piece prefitted with the connecting lines 15 is then placed through said window opening in self-inserting manner and connected to the connecting parts 17 of electric hotplate 2 and using an automatic multiple welding tongs 41 all the associated electrical joints are simultaneously produced by spot welding. The connecting lines 15 or the connecting piece 1 can be fixed by means of a tension relief means and if the grounding connection has not taken place in the already described manner, it can now be fixed to the holding part 4. All the processes can be carried out in fully mechanized manner with the aid of robots, which also applies with respect to the arrangement of the fitted cooker plates in a stack.

We claim:

1. An electric hotplate connecting piece for electrically connecting at least one connecting member of a hotplate to supply lines, comprising:

an isulator body for receiving at least one electric lead provided for connecting at least one connecting member of a hotplate to at least one supply line by means of at least one electric connection point, said at least one connection point having a projecting connecting part of said lead provided to be connected to a freely projecting, associated incoming connecting part, in a side view said lead defining a main longitudinal extension, wherein at least one connecting part of at least one lead is constructed for a crossing connection with the associated incoming connecting part in an associated one of the connection points, said at least one connecting part being oriented at an angle with respect to said main longitudinal extension when seen in side view.

2. The connecting piece according to claim 1, wherein adjacent connecting parts of substantially all leads are constructed for the crossing connection, all said leads being constructed substantially equal and being juxtaposed substantially parallel planes, said insulator body receiving said leads being separately tranversed by said leads.

3. The connecting piece according to claim 1, wherein at least one lead has connecting parts for two separate connection points, thereby providing at least one connecting part for connection to the connecting member and at least one connecting part for connection to the supply line, at least one connecting part for the connecting member and at least one connecting part for the supply line being constructed for said crossing connection.

4. The connecting piece according to claim 1, wherein at least one lead traversing said insulator body is constructed in one piece with a connecting wire of said electric hotplate, said connecting wire forming the connecting part for the crossing connection to the supply line with an end portion, said connecting wire being a preassembled component of the electric hotplate.

5. The connecting piece according to claim 1, wherein the connecting part of the particular lead is constructed for an approximately right-angled crossing connection, said connecting part being located at an angle of substantially 45° to said main longitudinal extension.

6. The connecting piece according to claim 5, wherein each connecting part has a greatest cross-sectional width at least one connecting part of the lead being constructed for a connection in which said connecting part projects at right angles to the incoming connecting part on at least one side of said incoming connecting part at the most by said greatest cross-sectional width.

7. The connecting piece according to claim 1, wherein at least one connecting part of at least one lead is located substantially at right angles to said main longitudinal extension, two remote connecting parts of said lead being provided in a common median longitudinal plane with a remaining portion of said lead.

8. The connecting piece according to claim 1, wherein said lead is formed by a longitudinal portion of a one-part strand of a wire having ends, said longitudinal portion having substantially constant cross-section between said ends and having at least one end at angles to said main longitudinal extension.

9. The connecting piece according to claim 1, wherein at least one connecting part of said lead is formed by a substantially linear, freely projecting end portion, two remote end portions projecting substantially beyond said insulator body on opposite sides.

10. An electric hotplate connecting piece for electrically connecting at least one connecting member of a hotplate to supply lines, comprising:

an isulator body for receiving at least one electric lead provided for connecting at least one connecting member of a hotplate to at least one supply line by means of at least one electric connection point, said at least one connection point having a projecting connecting part of said lead provided to be connected to a freely projecting, associated incoming conneting part, wherein at least one lead comprises a one-piece-stamped sheet metal part, at least one connecting part of said lead being located substantially in a common strip plane with a remaining portion of said lead.

11. The connecting piece according to claim 1 or 10, wherein at least one of said connecting parts of said lead has a connecting positive plugging member, forming at least one of a flat plugging tongue and a longitudinal stop for said lead.

12. The connecting piece according to claim 11, wherein at least one positive plugging member is formed by a separated flat component fixed to an associated bent end of said lead and engaging in substantially centered manner in said insulator body.

13. The connecting piece according to claim 11, wherein at least one positive plugging member is constructed in one piece with said lead.

14. An electric hotplate connecting piece for electrically connecting at least one connecting member of a hotplate to supply lines, comprising:

an insulator body for receiving at least one electrical lead provided for connecting at least one connecting member of a hotplate to at least one supply line by means of at least one electric connection point, said at least one connection point having a projecting connecting part of said lead provided to be connected to a freely projecting, associated incoming connecting part, wherein said lead has a length extension between ends and connecting parts, said lead being located substantially in a single median longitudinal plane over substantially said entire length extension, said lead being curved and bent several times in opposite directions between said ends and said connecting parts, at the most one of said ends being located transverse to said median longitudinal plane.

15. The connecting piece according to claim 1 or 14, wherein at least one connecting part of said lead projects beyond an associated end face of said insulator body by an amount larger than a cross-sectional width of said connecting part, said connecting part being located at an angle to said main longitudinal extension.

16. An electric hotplate connecting piece for electrically connecting at least one connecting member of a hotplate to supply lines, comprising:

an insulator body for receiving at least one electric lead provided for connecting at least one connecting member of a hotplate to at least one supply line by means of at least one electric connection point, said at least one connection point having a projecting connecting part of said lead provided to be connected to a freely projecting, associated incoming connecting part, wherein at least one centering guiding face is provided on an associated end face of said insulator body for guiding at least one said incoming connecting part, at least one guiding face having a sloping individual guiding face.

17. The connecting piece according to claim 1 or 16, wherein said guiding face has two facing funnel-like converging individual guiding faces, whereof one individual guiding face associated with the connecting part of said hotplate is substantially parallel to a main longitudinal direction of said lead.

18. The connecting piece according to claim 17, wherein at least one stop face is provided on an associated end face of said insulator body for abutting an end of at least one incoming connecting part, at least one of said stop faces being a bottom face of a recess connecting associated ones of said individual guiding faces.

19. The connceting piece according to claim 1 or 16, wherein said guiding faces located on an end of said insulator body associated with said hotplate are formed by a recess passing over substantially all of said connecting parts located at said end, said guiding faces being formed by a groove passing over a width extension of said insulator body.

20. The connecting piece according to claim 1 or 16, wherein said guiding faces located at an end of said insulator body associated with said supply lines are formed by separate centring recesses for each connecting part, each of said centering recesses being laterally connected to an associated one of said passage openings.

21. The connecting piece according to claim 1 or 16, wherein at least one of said connecting parts of said supply lines is formed by a multicore cable end provided for said crossing connection.

22. The connecting piece according to claim 1 or 16, wherein at least one of said connecting parts if constructed as a welding connector provided for spot welding.

23. An electric hotplate connecting piece for electrically connecting at least one connecting member of a hotplate to supply lines, comprising:

an insulator body for receiving at least one electric lead provided for connecting at least one connecting member of a hotplate to at least one supply line by means of at least one electric connection point, wherein at least one insulator body for receiving at most two leads has at least one connecting member for direct connection to at least one further similar insulator body.

24. The connecting piece according to claim 1 or 23, wherein said insulator body has lateral, complimentary plugging members on either side.

25. An electric hotplate connecting piece for electrically connecting at least one connecting member of a hotplate to supply lines, comprising:

an insulator body for receiving at least one electric lead provided for connecting at least one connecting member of a hotplate to at least one supply line by means of at least one electric connection point, said at least one connection point having a projecting connecting part of said lead provided to be connected to a freely projecting, associated incoming connecting part, wherein said lead traverses said insulator body in a slot-like passage opening adapted to a thickness of said lead prevented from rotating by lateral engagement in said passage opening.

26. An electric hotplate connecting piece for electrically connecting at least one connecting member of a hotplate to supply lines, comprising:

an insulator body for receiving at least one electric lead provided for connecting at least one connecting member of a hotplate to at least one supply line by means of at least one electric connection point, said at least one connection point having a projecting connecting part of said lead provided to be connected to a freely projecting, associated incoming connecting part, wherein said insulator body is formed by a flat body honed on an upper flat side for forming an engagement face for an underside of said hotplate.

27. An electric hotplate connecting piece for electrically connecting at least one connecting member of a hotplate to supply lines, comprising:

an insulator body for receiving at least one electric lead provided for connecting at least one connecting member of a hotplate to at least one supply line by means of at least one electric connection point, said at least one connection point having a connecting part of said lead provided to be connected to an associated incoming connecting part, wherein a casing-like insulating part for receiving at least one incoming connecting part of said supply lines is provided, said insulating part having substantially a same cross-sectional shape of a circumferential surface as said insulator body of the connecting piece.

* * * * *